US008028456B2

(12) United States Patent
Peterson

(10) Patent No.: US 8,028,456 B2
(45) Date of Patent: Oct. 4, 2011

(54) DETACHABLE VISUAL AUGMENTATION DEVICE (VAD) MOUNTING BRACKET FOR FIREARMS AND OPTICAL DEVICES

(75) Inventor: Morris Peterson, Earlysville, VA (US)

(73) Assignee: Ashbury International Group, Inc., Ruckersville, VA (US)

( * ) Notice: Subject to any disclaimer, the term of this patent is extended or adjusted under 35 U.S.C. 154(b) by 836 days.

(21) Appl. No.: 11/672,030

(22) Filed: Feb. 6, 2007

(65) Prior Publication Data

US 2008/0000134 A1 Jan. 3, 2008

Related U.S. Application Data

(60) Provisional application No. 60/743,235, filed on Feb. 6, 2006.

(51) Int. Cl.
*F41C 23/00* (2006.01)

(52) U.S. Cl. ..... 42/71.01; 42/75.01; 42/124

(58) Field of Classification Search ..... 42/71.01, 42/72, 75.01, 75.03, 85, 124
See application file for complete search history.

(56) References Cited

U.S. PATENT DOCUMENTS

| | | | | |
|---|---|---|---|---|
| 1,362,432 | A | 12/1920 | Masters | |
| 2,775,817 | A * | 1/1957 | Schuman | 42/125 |
| 3,205,580 | A * | 9/1965 | Osborn | 42/124 |
| 4,021,954 | A * | 5/1977 | Crawford | 42/127 |
| 4,533,980 | A | 8/1985 | Hayes | |
| 5,068,968 | A | 12/1991 | Sillery | |
| 5,142,806 | A | 9/1992 | Swan | |
| 5,343,650 | A * | 9/1994 | Swan | 42/117 |
| 5,784,822 | A | 7/1998 | Korapaty | |
| 5,787,630 | A | 8/1998 | Martel | |
| 5,926,964 | A | 7/1999 | Korapaty | |
| 6,007,034 | A | 12/1999 | Stoll et al. | |
| D447,532 | S | 9/2001 | Keng | |
| 6,381,895 | B1 | 5/2002 | Keeney et al. | |
| 6,490,822 | B1 * | 12/2002 | Swan | 42/71.01 |
| 6,609,321 | B2 * | 8/2003 | Faifer | 42/71.01 |

(Continued)

FOREIGN PATENT DOCUMENTS

EP 082257 12/1981

OTHER PUBLICATIONS

International Search Report and Written Opinion for PCT Application No. PCT/US2007/061720 dated Mar. 3, 2008.

*Primary Examiner* — Troy Chambers
(74) *Attorney, Agent, or Firm* — Troutman Sanders LLP; Robert R. Elliott, Jr.

(57) ABSTRACT

Various detachable firearm mounting bracket device embodiments are provided. According to an embodiment, a detachable mounting bracket is adapted to allow users of various weapons platforms and field optical devices to rapidly and securely attach visual augmentation devices to a firearm. A detachable mounting bracket can comprise a housing to attach to a firearm stock, a clamping mechanism to secure the housing to a firearm, and a rail interface adapted to receive a visual augmentation device. The detachable mounting bracket device can be attached to a firearm with a clamp, screw closure, and a vertical interlock clamp. After the detachable mounting bracket is attached to a firearm, a user can easily and rapidly secure a visual augmentation device to the rail interface. Other embodiments are also claimed and described.

23 Claims, 6 Drawing Sheets

U.S. PATENT DOCUMENTS

| | | | | |
|---|---|---|---|---|
| 6,779,288 | B1 * | 8/2004 | Kim | 42/72 |
| 6,836,990 | B2 * | 1/2005 | Shiloni | 42/96 |
| 6,854,206 | B2 * | 2/2005 | Oz | 42/124 |
| 6,895,708 | B2 * | 5/2005 | Kim et al. | 42/72 |
| 7,043,864 | B1 * | 5/2006 | Reed | 42/111 |
| 7,059,076 | B2 * | 6/2006 | Stoner et al. | 42/75.01 |
| 7,131,228 | B2 * | 11/2006 | Hochstrate et al. | 42/75.01 |
| RE39,465 | E * | 1/2007 | Swan | 42/71.01 |
| 7,216,451 | B1 * | 5/2007 | Troy | 42/72 |
| 7,524,288 | B2 * | 4/2009 | Chinn | 600/439 |
| 2003/0101632 | A1 * | 6/2003 | Davenport et al. | 42/85 |
| 2006/0179701 | A1 * | 8/2006 | Mossberg et al. | 42/77 |
| 2008/0301994 | A1 * | 12/2008 | Langevin et al. | 42/71.01 |

* cited by examiner

DETACHABLE VISUAL AUGMENTATION DEVICE (VAD) MOUNTING BRACKET FOR FIREARMS AND OPTICAL DEVICES

CROSS REFERENCE AND PRIORITY CLAIM TO RELATED APPLICATION

The present application claims priority to and the benefit of U.S. Provisional Patent Application No. 60/743,235, filed 6 Feb. 2006, and entitled "Detachable Visual Augmentation Device (VAD) Mounting Bracket For Firearms and Optical Devices", which is hereby incorporated by reference in its entirety as if fully set forth below.

TECHNICAL FIELD

The present invention relates generally to firearms, and more particularly, to detachable mounting brackets that enable visual augmentation devices to be rapidly and securely attached to firearms (in particular long guns), field optic devices, and electro-optic devices.

BACKGROUND

Many people have long utilized firearms to shoot projectiles of various sorts. For example, military personnel, law enforcement officers, hunters, and precision target shooters use different types of firearms (or weapons platforms) for different purposes. Usually, people use firearms, including long guns, in conjunction with an optical sight, or other visual augmentation devices ("VAD"), to assist them in observing, acquiring and or precisely aiming at a target. In most instances, VADs are mounted to a long gun and never removed, whereas in other instances, some use multiple VADs to allow for use during daylight hours, dark hours, and conditions of limited visibility. Some long gun users even go to great lengths in selecting an appropriate VAD to match a shooting condition and to provide helpful visual assistance to acquire an engage a target.

VADs are typically not suited and designed for many different shooting applications and/or environments. For example, some VADs may be for use in daylight hours while others are better suited for nighttime hours or observation thru visual obscurants (i.e. fog, rain, smoke, etc). Thus, some long gun users desire to utilize different VADs on the same firearm due to changes in the intended application, mission, reconnaissance or shooting environment.

Changing VADs on long guns poses not only skilled-technical challenges, but can also pose equipment adjustment and available tool challenges. For example, removing a daytime scope from a long gun and installing a nighttime scope may require a gunsmith or armorer and can take a considerable period of time—time that some long gun users can not afford to waste. Changing VADs can also possibly disturb a weapons point of impact or the calibration of the different VADs due to the installation and removal process.

Some manufactures have devised various mounting bracket devices to provide a platform for mounting different VADs. Typically, these mounting brackets are rigidly and permanently attached to the receiver or stock of a firearm and VADs can be attached or mounted to these brackets. With advancing technologies these existing mounting brackets can not accommodate supplemental or multiple VADs. Because of the rigid attachments of the mounting bracket, there is no current capability to rapidly attach and detach a mounting bracket to and from a weapon. Also, the rigid receiver and stock mounting process requires extensive amounts of precision gunsmithing and/or armorer support to install and maintain.

Several types of conventional mounting brackets that are rigidly attached to a weapons platform are now utilized. These include two rail systems: the McCann Industries Rail Systems (M.I.R.S. and S.I.R.S.) manufactured by McCann Industries in Spanaway, Wash. and the Modular Accessory Rail System (MARS) manufactured by Remington Arms Company, Inc.'s Military Products Division in Madison, N.C. While these accessory rail systems provide VAD mounts, these mounting brackets are not detachable and must be rigidly attached to a weapons platform. In addition, these conventional rail systems typically require professional gunsmith/armorer installation.

What is needed, therefore, is a simple to use and easy to install mounting bracket device that is easily attachable and detachable without professional assistance and that provides a secure mounting platform for one or more VADs without the use of tools. It is to the provision of such detachable mounting brackets that the embodiments of the present invention are directed.

SUMMARY

The embodiments of the present invention provide easily attachable and detachable mounting brackets that address the above-discussed and other drawbacks. A detachable mounting bracket according to the present invention can be quickly installed and removed in the field by an end-user without or with simple limited tools. Also, a detachable mounting bracket according to the present invention enables users of various weapons platforms and field optical devices to rapidly and securely attach VADs via a 1913 Picatinny Rail according to some embodiments.

Generally described, a mounting bracket according to the present invention can include a barrel bridge coupled to two side members that define a housing for encapsulating a portion of a weapon. One or more mounting rails can be coupled to the bracket so that one or more VADs and field stabilization devices (i.e. monopod, bipod, or tripod) can be attached to the bracket. The two side members can be adapted to be coupled together with a connection device so that the bracket is affixed to and securely attached to a weapon. Preferably, the connection device can be operated without tools enabling users to quickly attach the bracket to and remove the bracket from a weapon.

In another embodiment of the present invention, a detachable mounting bracket enabling attachment of at least one visual augmentation device to a firearm can comprise several components. These components can include a barrel bridge, a pair of side members, and a securing mechanism. The barrel bridge can be disposed proximate a portion of a barrel of the firearm. The pair of side members can be coupled to the barrel bridge, and the side members can enclose at least a portion of the firearm. The side members in combination with the barrel bridge define a housing that at least partially envelopes the firearm. A pair of hinge members can be used to hingedly attach the pair of side members to the barrel bridge. The side members may have a general "L"-shaped or generaly "U"-shaped cross section, and the side members may possibly interlock with each other to encapsulate a portion of the firearm. The securing mechanism can couple the side members together in a securedly detached arrangement. The securing mechanism can have at least one of an orthogonal or lateral orientation relative to the barrel of the firearm.

Other embodiments of the present invention's embodiments include other advantageous features. For example, a detachable mounting bracket preferably comprises at least one mounting rail disposed on at least one of the barrel bridge and the pair of side members to carry a visual augmentation device. Also, the barrel bridge can be curved to substantially correspond to the curvature of the barrel. The barrel bridge may also be positioned in a floating configuration above (or spaced apart from) the barrel such that the barrel bridge does not interfere with barrel harmonics.

A detachable mounting bracket can include still yet other features. For example, a bracket may comprise a compression material disposed on an inner surface of the pair of side members. The compression material can conform to and contact at least a portion of the firearm so that the housing is securedly attached to the firearm. Conformance may be desired due to the non-uniform exterior of a weapon or optic device. The compression material can have an operational temperature range between approximately −40 degrees Fahrenheit to approximately +170 degrees Fahrenheit.

In yet other embodiments of the present invention, a system to attach and detach a plurality of visual augmentation devices to a housing that is securedly attach to one of a firearm or optic device in a quick time period to aid the user of the firearm or optic device can comprise multiple housing features. For example, the housing can comprise a plurality of attachment rails, a plurality of sidewall members, and a connection mechanism. The plurality of attachment rails can be disposed on the exterior of the housing. The attachment rails preferably comprise attachment components to receive corresponding attachment components of the visual augmentation devices. The plurality of sidewall members can be disposed proximate a portion of the firearm or optic device. The sidewall members can be coupled together to encapsulate the portion of the firearm or optic device. Also, the connection mechanism can connect the plurality of sidewall members in an enclosed configuration, and the connection mechanism being disposed partially on at least one of the sidewall members.

The bracket housing embodiments of the present invention may also include other features. For example, the housing can comprise a bridge portion disposed above an upper portion of the firearm or optic device. The bridge portion can have a curved region substantially similar to a curved region of the firearm or optic device such that the housing envelops the upper portion of the firearm or optic device. Also, the housing can include a barrel bridge portion spaced apart from a portion of a barrel associated with the such that the barrel bridge portion does not contact the barrel. A material may be disposed between at least one of the sidewall members and the firearm such that when the at least one sidewall member is located proximate the firearm the material forms a rigid coupling between the at least one sidewall member and the firearm. The sidewall members may be hingedly coupled to the barrel bridge portion via hinge mechanisms. Also, the sidewall members may include corresponding interlocking components such that the two sidewall members can engagedly interlock with one another.

In still yet other embodiments of the present invention, a bracket to carry multiple visual augmentation devices can comprise a bridge portion, bracket sidewalls, and a securing mechanism. The bridge portion can have a substantially curved region to be disposed proximate a curved region of the device. Preferably, the bridge portion is spaced apart from the device. A first bracket sidewall can be connected to the bridge portion to enclose a portion of the device, and a second bracket sidewall connected to the bridge portion to enclose a portion of the device. The securing mechanism enables attachment and detachment of the first bracket sidewall and second bracket sidewall in an attached configuration and a detached configuration. The securing mechanism preferably include a latching mechanism configured for a portion of a human hand or finger such that the human hand or finger can adjust the latching mechanism between the attached configuration and the detached configuration. Advantageously this feature of some embodiments of the present invention enables use of a bracket without tools.

Other bracket embodiments have additional features. For example, a bracket can comprise a non-slip compressible material. This material can be disposed between a portion of the device and the first and second bracket sidewalls such that the first and second bracket sidewalls are fixedly secured to the portion of the device. The first and second bracket sidewalls can be hingedly connected to the bridge portion. Such connection enables in the attached configuration the bracket sidewalls to enclose a portion of the device and in the detached configuration the bracket sidewalls can be spaced apart from the portion of the device. The first and second bracket sidewalls can be generally "L"-shaped to envelop a portion of the device and the securing mechanism is disposed on an underside of the device to join the two "L"-shaped bracket sidewalls. Also, the bracket preferably comprises a plurality of interface mounts to receive corresponding interface mount components of the visual augmentation devices.

The detachable mounting bracket embodiments of the present invention can be attached to various weapons platforms and field optical devices using different methods. These different methods include a quick clamp method, a screw closure method, and a vertical interlock clamp. The embodiments of the present invention are discussed in more detail below with reference to the attached figures. Those skilled in the art will understand that the principles of the embodiments of the present invention can be utilized with many different types of firearms, guns, and weapons, including long guns, optics, and electro-optics.

Other aspects and features of embodiments of the present invention will become apparent to those of ordinary skill in the art, upon reviewing the following description of specific, exemplary embodiments of the present invention in conjunction with the accompanying figures.

DETAILED DESCRIPTION OF PREFERRED & ALTERNATIVE EMBODIMENTS

Figure 1:
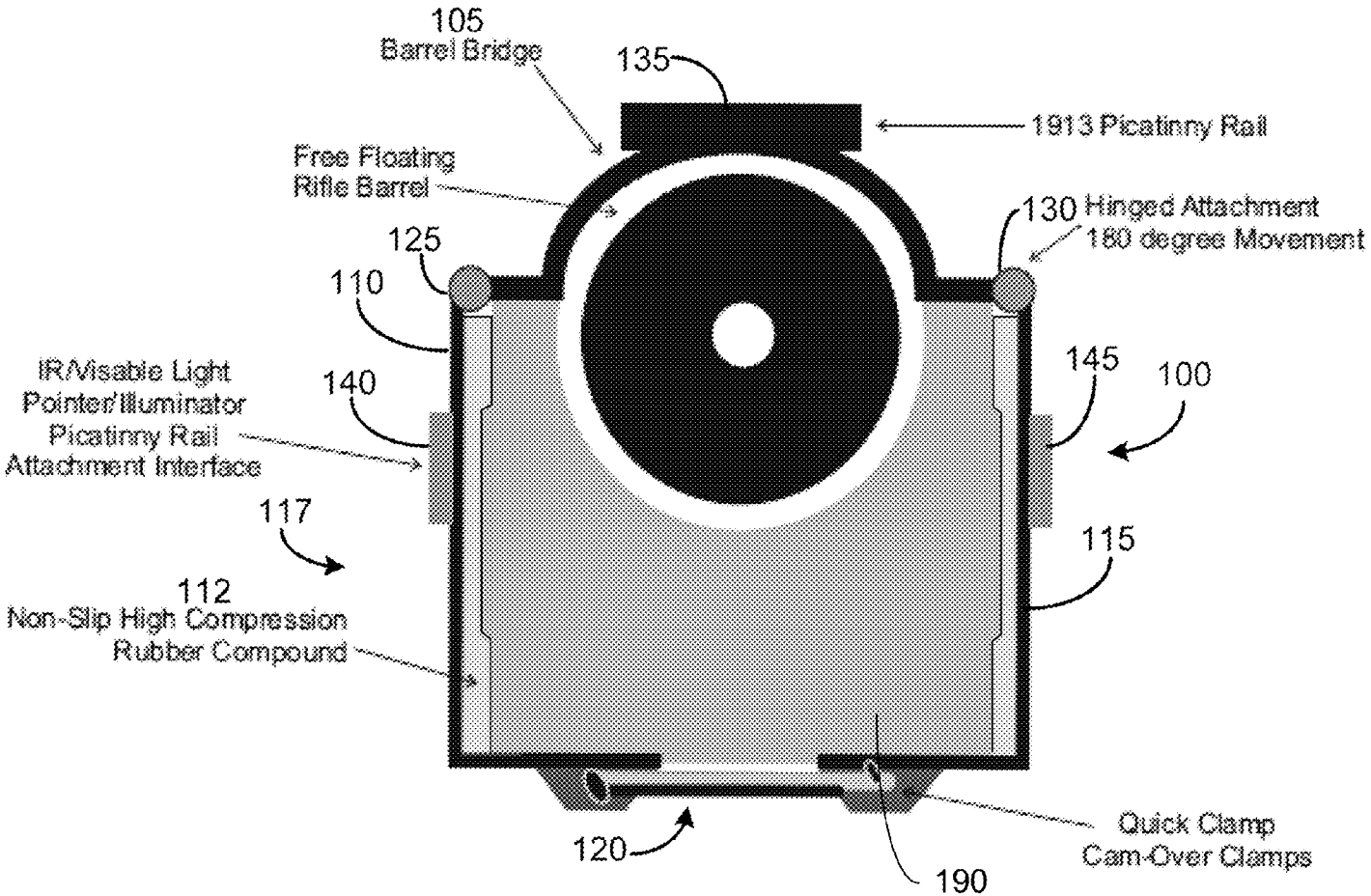
FIG. 1 illustrates a front view of a detachable mounting bracket to mount one or more VADs to a weapons platform and/or a field optical device in accordance with an embodiment of the present invention.

Referring now to the figures, wherein like reference numerals represent like parts throughout the several views, exemplary embodiments of the present invention will be described in detail. Throughout this description, various components may be identified having specific values or parameters, however, these items are provided as exemplary embodiments. Indeed, the exemplary embodiments do not limit the various aspects and concepts of the present invention as many comparable parameters, sizes, ranges, and/or values may be implemented.

The embodiments of the present invention provide a detachable firearm mounting bracket. The bracket can be easily attached to and removed from various weapons platforms, thus providing an easy to use VAD mounting bracket. Indeed, according to bracket embodiments of the present invention no tools are required thereby advantageously enabling a user to attach and detach a bracket. Other advantageous features of such bracket embodiments include reducing or eliminating damage done to a firearm or optics device.

As discussed herein, brackets according to the present invention enable one or more VADs to be attached to a weapon to aid a user in a wide range of environments. For example, the detachable mounting bracket device embodiments according to the present invention enable end users to rapidly attach VADs (e.g., in-line night vision weapon sight, laser range finder, laser pointer, thermal imager, etc.) to a shoulder fired weapon (e.g., service rifle, precision sniper rifle) so that the weapon can be used during daylight hours, night time hours, and during visually obscured conditions (e.g., foul weather, battlefield haze, etc.). In addition, users can quickly remove VADs to adjust for a change in operational conditions using a detachable mounting bracket in accordance with the present invention.

Referring now to the figures, FIG. 1 illustrates a front view of a detachable mounting bracket 100 to mount one or more VADs to a weapon in accordance with an embodiment of the present invention. As shown, the mounting bracket 100 encapsulates or partially surrounds a portion of a barrel of a weapon. Preferably, the mounting bracket 100 is at least partially attached to a stock portion of a weapon. In alternative arrangements or configurations, the mounting bracket 100 can be attached to other portions of a weapon.

As shown in FIG. 1, the bracket 100 comprises several components. These components include a barrel bridge 105, a first side member 110, a second side member 115, and a connection mechanism 120. As shown, the first side member 110 and the second side member 115 can be generally L-shaped. The mounting bracket 100 can also include a first hinge 125 and a second hinge 130. The first and second hinges 125, 130 can hingedly couple the first side member 110 and the second side member 115 to the barrel bridge 105. The bracket 100 can also comprise a compression material 112 coupled to the first side member 110 and the second side member 115 enabling contact between the bracket 100 and a stock portion 190 of a weapon. The mounting bracket 100 also preferably comprises a rail mount 135 coupled to the barrel bridge 105. In addition, the mounting bracket 100 can include one or more rail mounts 140, 145 and 255 (shown in FIG. 6) coupled to the first side member 110 and the second side member 115. The barrel bridge 105 and the side members 110, 115 can define a housing 117 housing a portion of a weapon.

The bracket 100 can be manufactured with various materials. For example, the bracket 100 can be manufactured from a lightweight, high-tensile-strength aluminum. Other materials include aluminum alloys, scandium, titanium, and magnesium. Alternative materials such as titanium and polymer resin plastic may also be utilized. Preferably, the utilized materials are selected to reduce weight, increase strength, and to eliminate or reduce damage to a firearm or optic device. In addition, one or more materials can be used to manufacture the bracket 100. Different materials can be used to provide a weight savings, increase bracket 100 strength, and to vary bracket 100 price. In addition, the bracket 100 can have an anodized or hard anodized protective surface coating and non reflective finish.

In accordance with a preferred embodiment of the present invention, the rail mounts 135, 140, 145 are Mil-Spec 1913 Picatinny rails. Those skilled in the art will understand that the 1913 Picatinny rail is a multi-purpose interface rail used on firearms to provide a standardized mounting platform for VADs, such as sights, scopes, tactical lights, and laser sighting modules. The rail mounts 135, 140, 145 can be manufactured with aluminum, steel, polymer resin plastic, or a combination thereof. In accordance with a preferred embodiment of the present invention, the rail mounts 135, 140, 145 are Mil-Spec 1913 Picatinny rails. Those skilled in the art will understand that the 1913 Picatinny rail is a multi-purpose interface rail used on firearms to provide a standardized mounting platform for VADs, such as sights, scopes, electro-optics, tactical lights, and laser sighting modules. The rail mounts 135, 140, 145 and 255 can be manufactured with aluminum, steel, polymer resin plastic, or a combination thereof. In addition to the 1913 Picatinny rail, other mounting rails can be utilized as the rail mounts 135, 140, 145 and 255 (shown in FIG. 6) in accordance with embodiments of the present invention.

The barrel bridge 105 is preferably curved to fit the curvature of a weapon barrel as illustrated in FIG. 1. Also, the barrel bridge 105 is preferably designed to fit over a wide range of barrel contours and is adapted to not interfere with barrel harmonics. The barrel bridge 105 can have varying height and width dimensions depending on the weapons platform or optics device being utilized. The barrel bridge 105 preferably does not contact the barrel so as to not change the barrel harmonics and adversely affect projectile point of impact when fired from a weapons platform.

As discussed above, the bracket 100 includes a barrel bridge 105 that fits over a rifle barrel (or optical axis in the case of it being used on a field optic). This enables the bracket 100 to be securely affixed to a weapon/optical device. For example, if the weapon is a rifle, the barrel bridge 105 can be affixed to the stock portion of the rifle as the stock portion is a rigid structure. When the barrel bridge 105 is properly situated on the stock portion of a weapon, other components of the bracket 100 enable the bracket 100 to be attached to the weapon.

Figure 2:
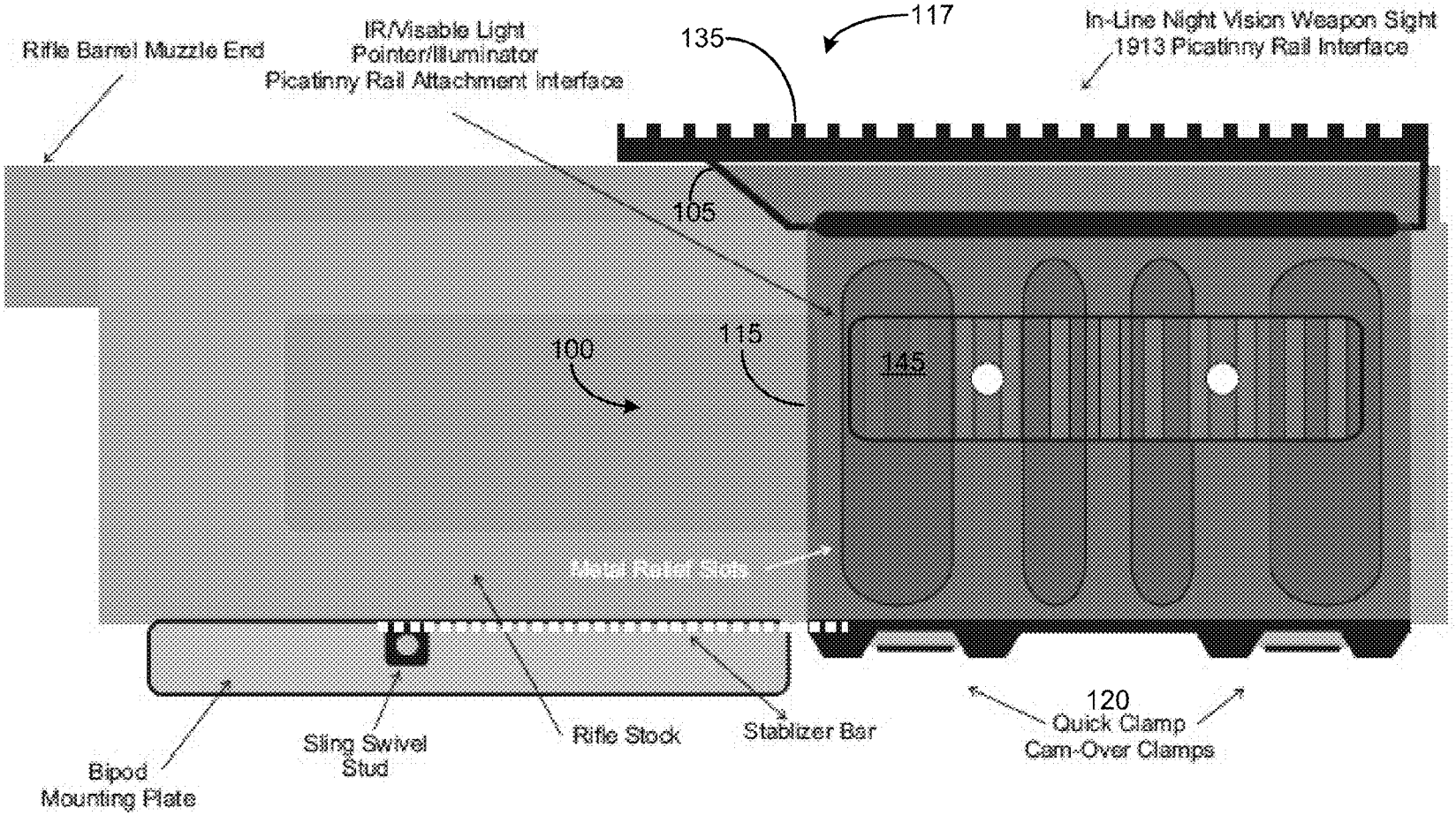
FIG. 2 illustrates a side view of a detachable mounting bracket to mount one or more VADs to a weapons platform and/or a field optical device in accordance with an embodiment of the present invention.

The first side member 110 and the second side member 115 are coupled to the barrel bridge 105 and can encapsulate the weapon as shown in FIGS. 1 and 2. The side members 110, 115 are preferably hingedly coupled to the barrel bridge 105 so that when the barrel bridge 105 is seated on a barrel, the side members 110, 115 can hinge to surround the portion of a weapon below the barrel, which can be a body or stock portion of a weapon in some embodiments of the present invention. The first and second hinges 125, 130 can be used to hingedly couple the side members 110, 115 to the barrel bridge 105.

Figure 3:
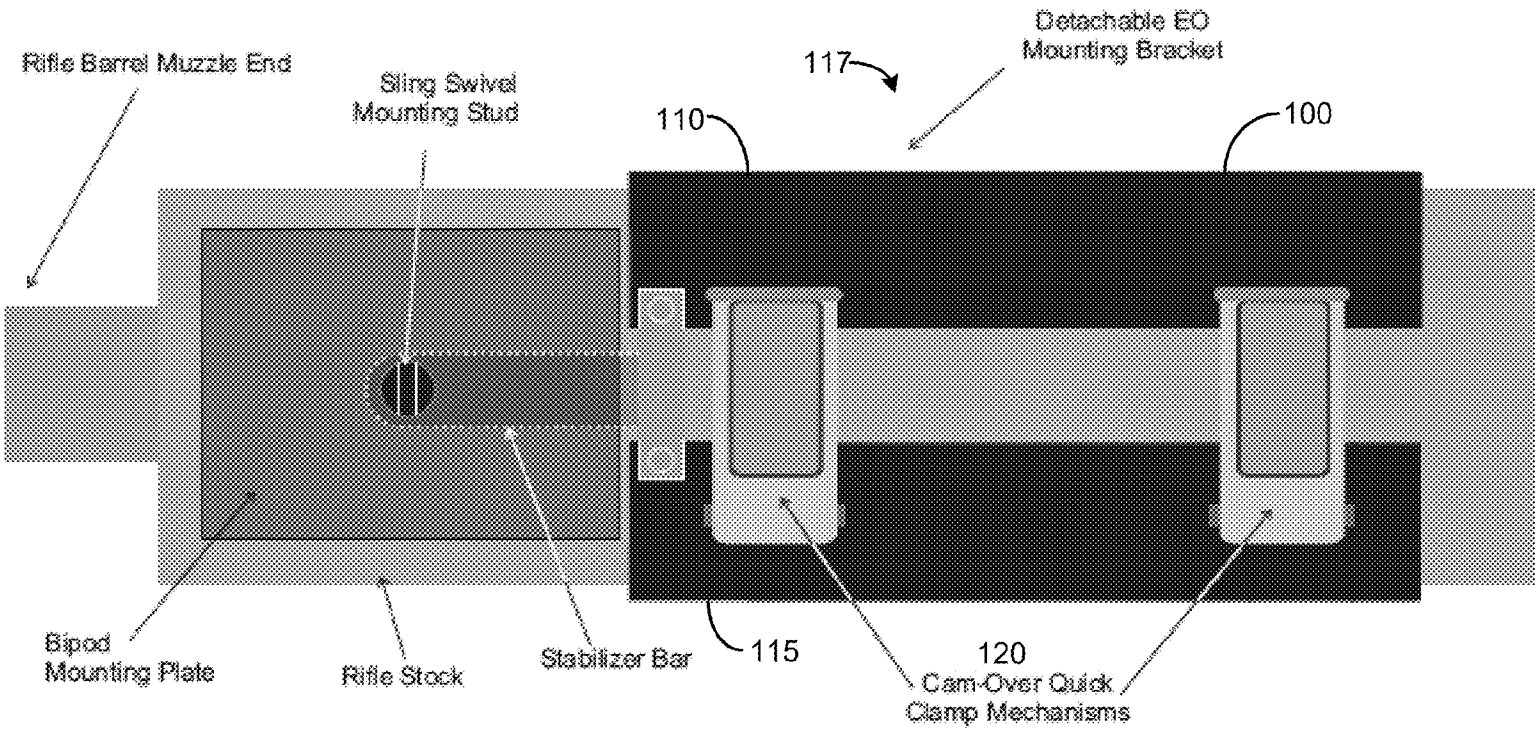
FIG. 3 illustrates a bottom view of a detachable mounting bracket to mount one or more VADs to a weapons platform and/or a field optical device in accordance with an embodiment of the present invention.

When the side members 110, 115 are placed in a closed position to encapsulate a portion of a weapon, the side members 110, 115 can be coupled to each other as shown in FIG. 3. Coupling the side members 110, 115 to each other enables the bracket 100 to be firmly and tightly affixed to a weapon. Also, the compression material 112 can ensure a tight mechanical coupling between the side members 110, 115 and the sides of a weapon. The compression material 112 can be a rubber or polyethylene compound that conforms to the stock portion of a weapon to form a non-slip interface. The compression material 112 can have a varying thickness and preferably has an operational temperature ranges between approximately −40 degrees Fahrenheit to approximately +170 degrees Fahrenheit. Advantageously, this temperature operating range enables the compression material to work in a wide range of environmental and operating temperatures including enduring heat produced by a firearm.

In accordance with embodiments of the present invention, a connection mechanism 120 can be used to secure the side members 110, 115 to each other. In a preferred embodiment, the connection mechanism 120 can be one or more clamps as shown in FIG. 3. Clamps enable a user to couple the side members 110, 115 to each other and secure the bracket to a weapon without the use of tools. In a preferred embodiment, a cam-over clamp can be the connection mechanism 120. The connection mechanism 120 can also be other fastening devices, such as one or more machine screws.

In accordance with embodiments of the present invention, the connection mechanism 120 can have various placement positions. For example, as shown in FIG. 3, the connection mechanism 120 has a vertical placement such that the connection mechanism 120 is orthogonal to the barrel of the weapon. In other embodiments, the connection mechanism 120 can have a lateral position such that the connection mechanism 120 is parallel to the barrel of the weapon. For example, clamps and machine screws can secure the bracket 100 laterally.

Figure 4:
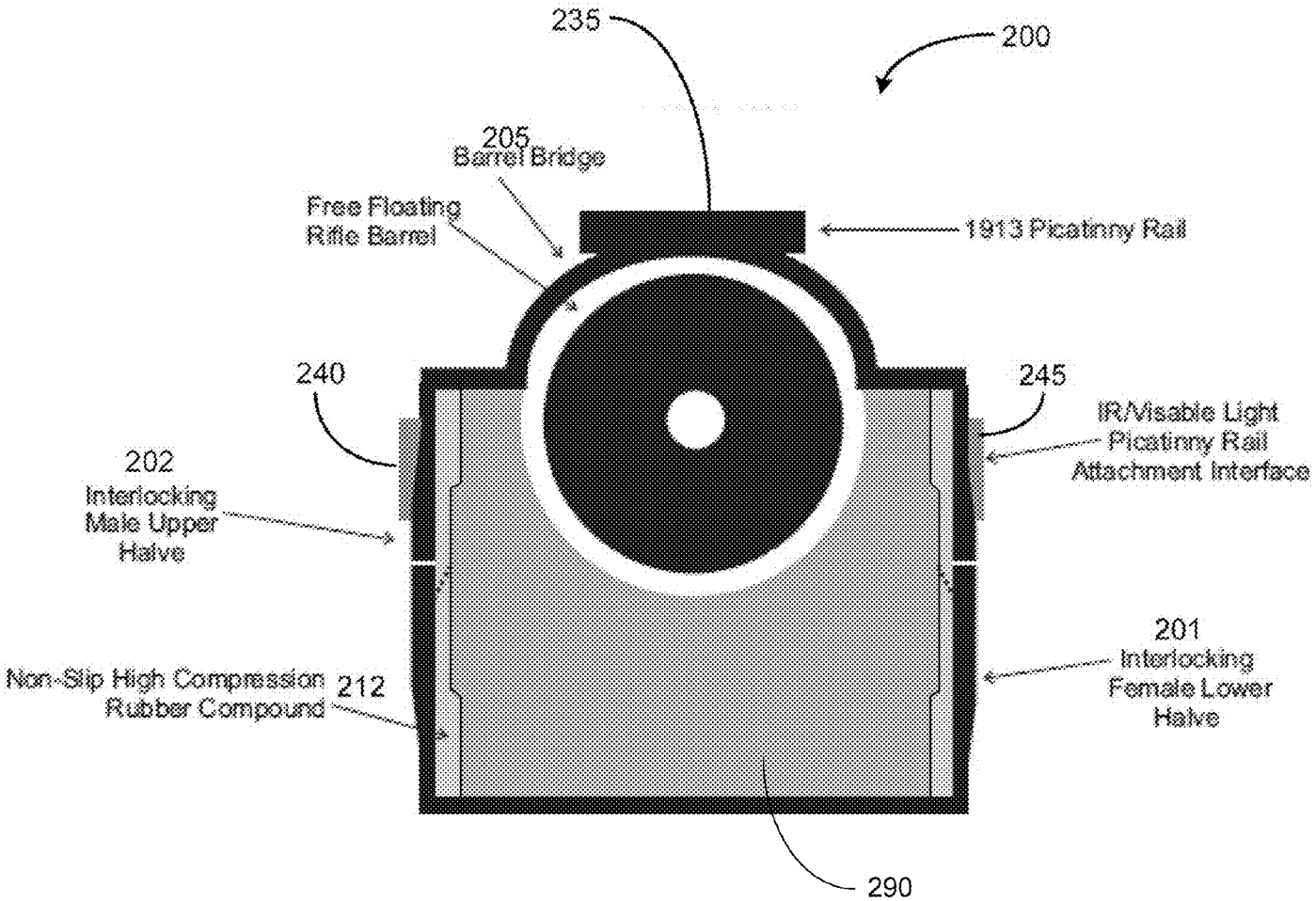
FIG. 4 illustrates a front view of a detachable interlocking mounting bracket to mount one or more VADs to a weapons platform and/or a field optical device in accordance with an embodiment of the present invention.
Figure 5:
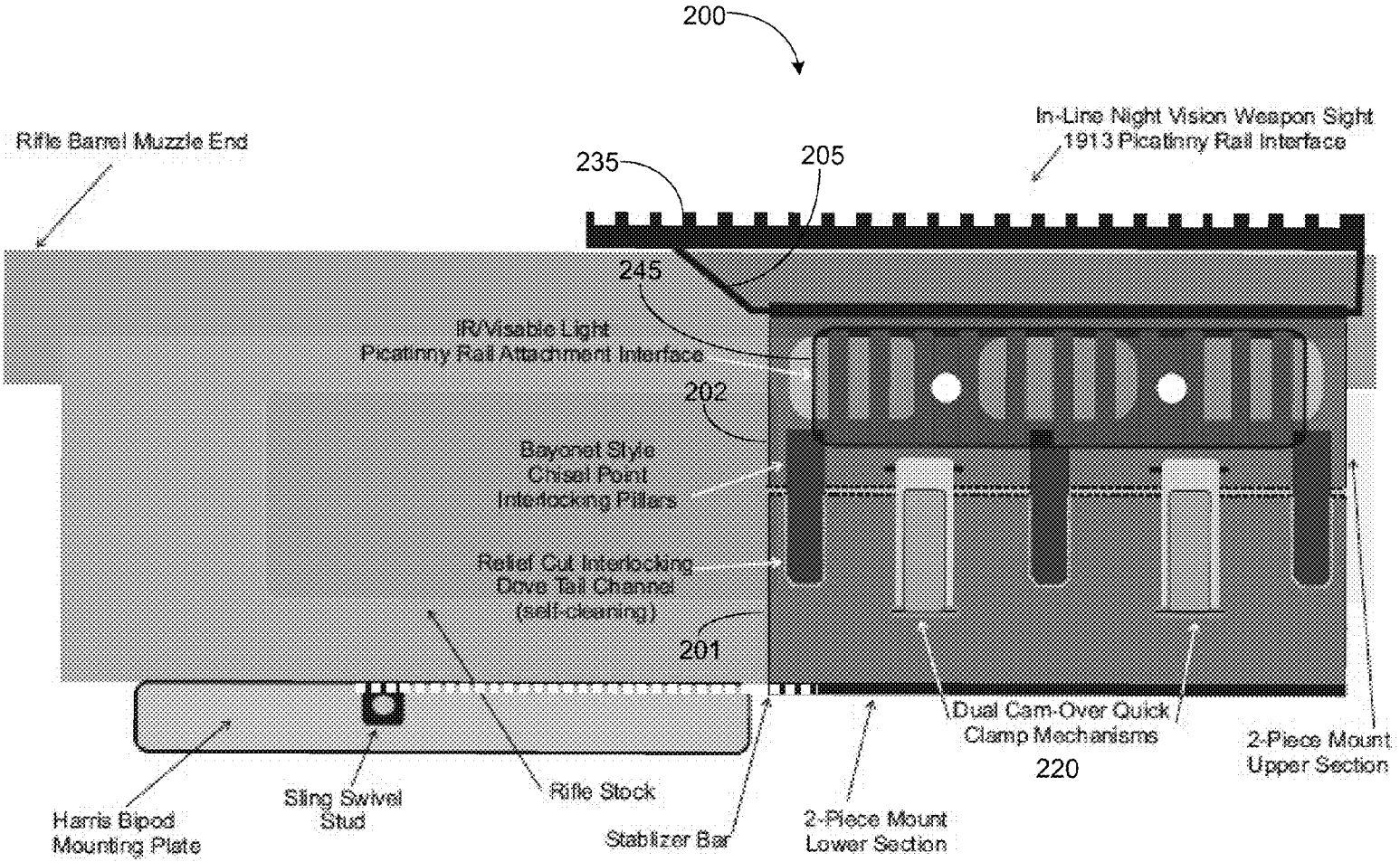
FIG. 5 illustrates a side view of a detachable interlocking mounting bracket to mount one or more VADs to a weapons platform and/or a field optical device in accordance with an embodiment of the present invention.
Figure 6:
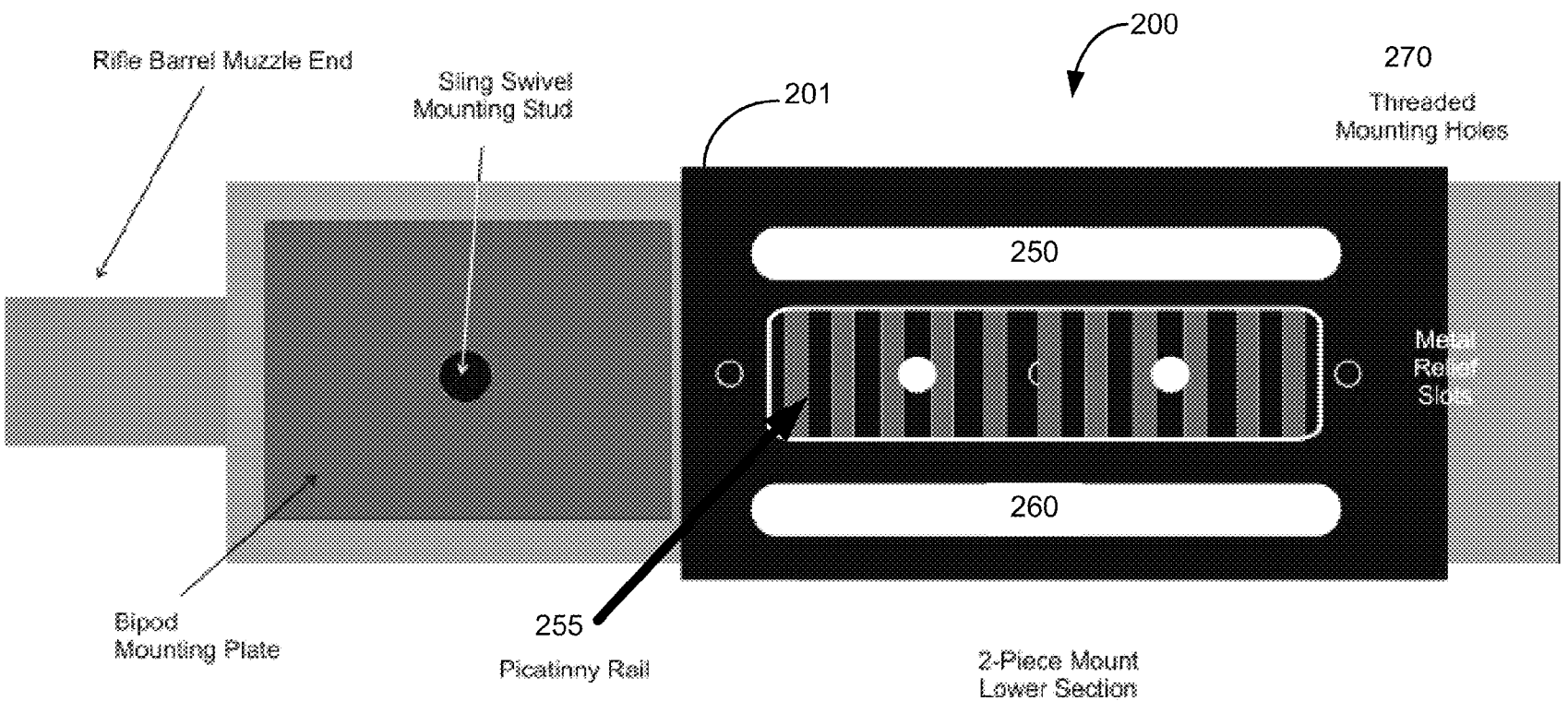
FIG. 6 illustrates a bottom view of a detachable interlocking mounting bracket to mount VADs to a weapons platform and/or a field optical device in accordance with an embodiment of the present invention.

Embodiments of the present invention also include additional detachable bracket embodiments. FIGS. 4-6 illustrate various views of an interlocking detachable bracket embodiment according to the present invention. As shown in these figures, an interlocking bracket 200 can be affixed to a weapon to provide mounts for one or more VADs. The bracket 200 generally has two U-shaped pieces 201, 202. The U-shaped pieces 201, 202 are preferably adapted to lock and engage one another around the stock portion 290 of a weapon. For example, the top piece 202 can have female dovetails on each side, and the bottom piece 201 can have corresponding male chisel point bayonet rails as shown in FIG. 5. The bottom piece 201 can have one more relief slots 250, 260 and can encapsulate the lower (or under) portion of a weapon. The bottom piece 201 can have a 1913 spec Picatinny Rail 255 attached to facilitate the attachment of VAD's or field stabilization devices. Additionally there can a series of longitudinal threaded screw holes 270 that can facilitate the attachment of other interface mounts. The top piece 202 can encapsulate the upper portion of a weapon, and can interlock with the bottom piece 201 to form a housing.

The bracket 200 can also have additional features. For example, the bracket 200 can include a barrel bridge 205, compression material 212, a connection mechanism 220, a top rail 235, and side rails 240, 245. As shown, the barrel bridge 205 can form a portion of the top piece 202, and the top rail 235 can be coupled to the top piece 202 at the barrel bridge 205 portion. Side rails 240, 245 can also be coupled to the sides of the top piece 202 to provide additional VAD mounting capabilities. The rails 235, 240, 245 are preferably 1913 Picatinny Mil-Spec rails providing VAD mounting interfaces. The compression material 212 can be similar to compression material 112 discussed above and can be placed along the interior of the top and bottom U-shaped pieces 201, 202.

The U-shaped pieces 201, 202 can be interlocked or coupled together in various arrangements according to the present invention. Interlocking the U-shaped pieces 201, 202 together enables the bracket 200 to be securely attached to a weapon. According to some embodiments of the present invention, the bottom and top pieces 201, 202 can be adapted to slide together, thus forming an interlocked device. In addition, as illustrated in FIG. 5, one or more clamps 220 can be used to securely couple the U-shaped pieces together 201, 202. For example, the bottom and top pieces 201, 202 can be secured to each other with a vertically mounted connection mechanism 220, which can be cam-over clamps. Other connection mechanisms include vertically mounted screw fasteners.

The bracket embodiments of the present invention can be scaled in size to fit and function on a wide range of weapons platforms and field optic devices. For example, weapons platforms employing a day sight can utilize a bracket to attach a range of electro-optic devices and sensors to a weapons platform. These devices include, but are not limited to, thermal imagers, night vision, cameras, visible light illuminators, infrared illuminators, aiming devices, and laser target pointers and designators.

The bracket embodiments of the present invention can also be attached to a broad range of weapons platforms. These include, but are not limited, handguns, air rifles, sporting rifles, shotguns, less-than-lethal weapons (e.g., physical projectile, chemical agent, baton, sound, light, laser, net, etc.), military combat rifles, individual shoulder fired weapons, crew served weapons, anti-armor weapons, water cannons, and high intensity visible and IR Light Sources.

The bracket embodiments of the present invention can also be used to attach a broad range of field optical devices to a weapons platform. The range of these devices includes electro-optic devices and sensor and visual augmentation devices. These optic field devices can include, but are not limited to, thermal imagers, night vision, cameras, visible light illuminators, infrared illuminators, aiming devices, and laser target pointers and designators. Still yet other field optical devices include binoculars, spotting scopes, telescopes, rifle scopes, laser range finders, video cameras, and closed circuit television cameras (CCTV).

While the various embodiments of this invention have been described in detail with particular reference to exemplary embodiments, those skilled in the art will understand that variations and modifications can be effected within the scope of the invention as defined in the appended claims. Accordingly, the scope of the various embodiments of the present invention should not be limited to the above discussed embodiments, and should only be defined by the following claims and all equivalents.

I claim:

1. A detachable mounting bracket enabling attachment of at least one visual augmentation device to a firearm, the detachable mounting bracket comprising:

a barrel bridge to be disposed proximate a portion of a barrel of the firearm;

a pair of side members coupled to the barrel bridge, the side members enclosing at least a portion of the firearm such that the side members in combination with the barrel bridge define a housing that at least partially envelopes a portion of the firearm, the side members being each hingedly attached to the barrel bridge and comprising a first, open position and a second, closed position; and one or more securing mechanisms to detachably couple the side members together in the second position;

wherein the side members frictionally couple the detachable mounting bracket to the portion of the firearm in the second position.

2. The detachable mounting bracket of claim 1, further comprising at least one mounting rail disposed on at least one of the barrel bridge and the pair of side members to carry a visual augmentation device.

3. The detachable mounting bracket of claim 1, the barrel bridge being curved to substantially correspond to the curvature of the barrel and positioned in a floating configuration above the barrel such that the barrel bridge does not interfere with barrel harmonics.

4. The detachable mounting bracket of claim 1, further comprising a compression material disposed on an inner surface of the pair of side members to contact at least a portion of the firearm so that the housing is securedly attached to the firearm.

5. The detachable mounting bracket of claim 1, further comprising a compression material disposed on an inner surface of the pair of side members, the compression material having an operational temperature range between approximately −40 degrees Fahrenheit to approximately +170 degrees Fahrenheit.

6. The detachable mounting bracket of claim 1, wherein the securing mechanism has at least one of an orthogonal or lateral orientation relative to the barrel of the firearm.

7. The detachable mounting bracket of claim 1, wherein the side members both have at least one of a general "L"-shaped or "U"-shaped cross section.

8. The detachable mounting bracket of claim 1, wherein the side members interlock with each other to encapsulate a portion of the firearm.

9. In a system for quickly attaching and detaching a plurality of visual augmentation devices to a housing that is securedly attached to one of a firearm or optic device, the housing for carrying the plurality of visual augmentation devices, the housing comprising:

a plurality of attachment rails disposed on the exterior of the housing, the attachment rails comprising attachment components to receive corresponding attachment components of the visual augmentation device;

a plurality of sidewall members disposed proximate a portion of the firearm or optic device, the sidewall members being coupled together to encapsulate the portion of the firearm or optic device, the sidewall members being hingedly coupled to a barrel bridge portion of the housing enabling the sidewall members to hinge laterally with respect to the barrel bridge portion to move between an open and closed position; and a connection mechanism to secure the plurality of sidewall members in the closed position, the connection mechanism being disposed partially on at least one of the sidewall members;

wherein the plurality of sidewall members frictionally clamp the housing to the portion of the firearm in the closed position.

10. The housing of claim 9, further comprising a bridge portion disposed above an upper portion of the firearm or optic device, the bridge portion having a curved region substantially similar to a curved region of the firearm or optic device such that the housing envelops the upper portion of the firearm or optic device.

11. The housing of claim 9, further comprising a barrel bridge portion spaced apart from a portion of a barrel associated with the such that the barrel bridge portion does not contact the barrel.

12. The housing of claim 11, further comprising a material disposed between at least one of the sidewall members and the firearm such that when the at least one sidewall member is located proximate the firearm the material forms a rigid coupling between the at least one sidewall member and the firearm.

13. The housing of claim 9, wherein at least two of the sidewall members include corresponding interlocking components such that the two sidewall members can engagedly interlock with one another.

14. A bracket to carry multiple visual augmentation devices for use with a device, the bracket comprising:

a bridge portion having a substantially curved region to be disposed proximate a curved region of the device, the bridge portion being spaced apart from the device;

a first bracket sidewall connected to the bridge portion to enclose a portion of the device, the first bracket sidewall being hingedly connected to the bridge portion enabling the first bracket sidewall to hinge between an open and closed position with respect to the device;

a second bracket sidewall connected to the bridge portion to enclose a portion of the device, the second bracket sidewall being hingedly connected to the bridge portion enabling the second bracket sidewall to hinge between an open and closed position with respect to the device; and a securing mechanism to secure the first bracket sidewall to the second bracket sidewall in the closed position;

wherein the bracket is securely attached to the device when the first and second bracket sidewall are secured in the closed position by the securing mechanism; and wherein the bracket can be installed and removed from the device without tools when the first and second bracket sidewalls are in the open position.

15. The bracket of claim 14, further comprising a non-slip compressible material disposed between a portion of the device and the first and second bracket sidewalls such that the first and second bracket sidewalls are fixedly secured to the portion of the device.

16. The bracket of claim 15, the first and second bracket sidewalls being hingedly connected to the bridge portion such that in attached configuration the bracket sidewalls enclose a portion of the device and in the detached configuration the bracket sidewalls can be spaced apart from the portion of the device, and wherein the first and second bracket sidewalls have a range of motion between 0 degrees and up to about 180 degrees.

17. The bracket of claim 16, wherein first and second bracket sidewalls are generally "L"-shaped to envelop a portion of the device and the securing mechanism is disposed on an underside of the device to join the two "L"-shaped bracket sidewalls.

18. The bracket of claim 17, further comprising a plurality of interface mounts to receive corresponding interface mount components of the visual augmentation devices.

19. A detachable mounting bracket enabling attachment of at least one visual augmentation device to a firearm, the detachable mounting bracket comprising:

a first U-shaped element comprising a barrel bridge to be disposed proximate a portion of a barrel of a firearm, the barrel bridge comprising a raised curved portion flanked by substantially planar portions, the first U-shaped element further comprising opposed sidewall members that each extend down from a respective substantially planar portion;

a second U-shaped element configured to be positioned in an inverse arrangement with respect to the first U-shaped element, the second U-shaped element comprising a planar shelf flanked by vertical sidewalls, the vertical sidewalls sized and shaped to be proximate the opposed sidewall member of the first U-shaped element when mated together;

the first U-shaped element and the second U-shaped element each comprising continuous end portions terminating the opposed sidewall member of the first U-shaped element and the vertical sidewalls of the second U-shaped members, the continuous ends of the first and second U-shaped elements being sized and shaped to enable the first and second U-shaped elements to slide together to form an interlocked bracket; and a plurality of clamp mechanisms disposed on outer surfaces of the first U-shaped element and the second U-shaped element and positioned to enable the first and second U-shaped elements to be locked together to form a locked bracket;

wherein the locked bracket is sized and shaped such that the first and second U-shaped elements clamp around a portion of the firearm, other than the barrel or the barrel nut, to detachably affix the bracket to the firearm.

20. The detachable mounting bracket of claim 19, further comprising a plurality of interlocking pillars extending between the first and second U-shaped elements.

21. The detachable mounting bracket of claim 19, further comprising at least one mounting rail disposed on at least one of the first and second U-shaped elements, the at least one mounting rail being sized and shaped to carry a visual augmentation device.

22. The detachable mounting bracket of claim 19, further comprising a non-slip compressible material disposed on at least one inner area of the first or second U-shaped elements.

23. The detachable mounting bracket of claim 19, wherein the raised portion of the barrel bridge is sized and shape to be spaced apart from a portion of a barrel such that the barrel bridge portion does not contact the barrel when the bracket is attached to a firearm.

* * * * *